US008421809B2

(12) United States Patent
Sumi

(10) Patent No.: US 8,421,809 B2
(45) Date of Patent: Apr. 16, 2013

(54) DISPLAY CONTROL DEVICE

(75) Inventor: Naoki Sumi, Hyogo (JP)

(73) Assignee: Chimei Innolux Corporation, Chu-Nan (TW)

( * ) Notice: Subject to any disclaimer, the term of this patent is extended or adjusted under 35 U.S.C. 154(b) by 240 days.

(21) Appl. No.: 12/787,964

(22) Filed: May 26, 2010

(65) Prior Publication Data

US 2010/0302265 A1 Dec. 2, 2010

(30) Foreign Application Priority Data

May 29, 2009 (JP) ..... 2009-131227

(51) Int. Cl.
*G09G 5/36* (2006.01)

(52) U.S. Cl.
USPC ..... 345/545; 345/530; 345/531; 345/532; 345/533; 345/534; 345/535; 345/536; 345/537; 345/538; 345/539; 345/540; 345/541; 345/542; 345/543; 345/544; 345/546; 345/547

(58) Field of Classification Search ..... 345/530–547
See application file for complete search history.

(56) References Cited

U.S. PATENT DOCUMENTS

| | | | |
|---|---|---|---|
| 2002/0195559 | A1 | 12/2002 | Miseki |
| 2004/0012673 | A1 | 1/2004 | Tanase et al. |
| 2004/0196254 | A1 | 10/2004 | Mizumaki |
| 2005/0253785 | A1 | 11/2005 | Miyasaka |
| 2007/0290964 | A1 * | 12/2007 | Yang ..... 345/87 |
| 2008/0131030 | A1 | 6/2008 | Tokutomi et al. |
| 2009/0201238 | A1 | 8/2009 | Shiomi |
| 2009/0262251 | A1 | 10/2009 | Teragawa |

FOREIGN PATENT DOCUMENTS

| | | | |
|---|---|---|---|
| JP | 9-172618 | A | 6/1997 |
| JP | 11-261927 | A | 9/1999 |
| JP | 2002-359775 | A | 12/2002 |
| JP | 2004309657 | A | 11/2004 |
| JP | 2005173387 | A | 6/2005 |
| JP | 2006-337448 | | 12/2006 |
| JP | 2008-141402 | A | 6/2008 |
| JP | 2008-160793 | A | 7/2008 |
| JP | 2009003420 | A | 1/2009 |
| WO | 2007122825 | A1 | 11/2007 |
| WO | 2008056457 | A1 | 5/2008 |

OTHER PUBLICATIONS

WO/2008/035472. Publication Date: Mar. 27, 2008.*

* cited by examiner

*Primary Examiner* — Ke Xiao
*Assistant Examiner* — Kim-Thanh T Tran
(74) *Attorney, Agent, or Firm* — Kirton McConkie; Evan R. Witt

(57) ABSTRACT

A display control device for controlling a display panel includes a contents frame rate detector detecting a contents frame rate of an input image data and outputting a repetitive frame number dependent from a display frame rate of the display panel and the detected contents frame rate; a frame memory for storing a level data of a previous frame; and an emulated level generator in communication with the contents frame rate detector and the frame memory. An output level data to the display panel is generated according to the repetitive frame number from the contents frame rate detector, the previous level data from the frame memory and an input level data of the input image data.

2 Claims, 6 Drawing Sheets

| Frame time point | Input level | | Output level | |
|---|---|---|---|---|
| | Original | From frame memory | To frame memory | To display panel |
| 0 | 0 | 0 | 0 | 0 |
| 1 | 0 | 0 | 0 | 0 |
| 2 | 0 | 0 | 0 | 0 |
| 3 | 0 | 0 | 0 | 0 |
| 4 | 63 | 0 | 8 | 8 |
| 5 | 63 | 8 | 32 | 32 |
| 6 | 63 | 32 | 56 | 56 |
| 7 | 63 | 56 | 63 | 63 |
| 8 | 63 | 63 | 63 | 63 |
| 9 | 63 | 63 | 63 | 63 |
| 10 | 63 | 63 | 63 | 63 |

FIG.2

| Frame time point | Nfrm | Counted value | Input level | | Output level | |
|---|---|---|---|---|---|---|
| | | | Original(Gn) | From frame memory(Gn-1) | To frame memory | To display panel |
| 0 | 4 | 1 | 0 | 0 | 0 | 0 |
| 1 | 4 | 2 | 0 | 0 | 0 | 0 |
| 2 | 4 | 3 | 0 | 0 | 0 | 0 |
| 3 | 4 | 4 | 0 | 0 | 0 | 0 |
| 4 | 4 | 1 | 63 | 0 | 0 | 16 |
| 5 | 4 | 2 | 63 | 0 | 0 | 32 |
| 6 | 4 | 3 | 63 | 0 | 0 | 47 |
| 7 | 4 | 4 | 63 | 0 | 63 | 63 |
| 8 | 4 | 1 | 63 | 63 | 63 | 63 |
| 9 | 4 | 2 | 63 | 63 | 63 | 63 |
| 10 | 4 | 3 | 63 | 63 | 63 | 63 |

FIG.5

DISPLAY CONTROL DEVICE

FIELD OF THE INVENTION

The present invention relates to a display control device, and more particularly to a display control device for controlling a liquid crystal display.

BACKGROUND OF THE INVENTION

The response of a liquid crystal display (LCD) is generally slower than the response of a plasma display, and is now improved in an order of several milliseconds to ten more milliseconds so as to trace the early stage of image. In addition to LCD and plasma displays, other displays such as organic electroluminescence (EL) displays, organic light-emitting diode (OLED) displays, field emission displays (FED), surface-conduction electron-emitter display (SED), etc., which have enhanced response speed, are under development. Prior art includes Japanese Patent Publication No. 2006-337448.

For a display with a quick response, if the frame rate of the contents themselves to be displayed is relatively low or the frame rate of the displayed image is relatively low due to the displaying mode, detailed flicker that reveals an unsmooth edge or discontinuous action of image, particularly the image of a moving object such as a hand or a leg, may occur. Such detailed flicker does not bother a display with a slow response but does cause problems to the effort in hastening the response speed.

For example, a conventional film is taken with 24 frames per second. If the response of a display is much quicker than the rate, an action of an object shown in the display would be suddenly and unnaturally stopped at times. In another example, the frame rate of a one seg TV displayed in for example a mobile phone is about 15 frames per second. The discontinuity of displayed image is even serious when the display is with a high response speed.

Enhancing the frame rate of contents may help in alleviating discontinuity, but is not applicable to the case that the contents are fixed and the frame rate is unchangeably low.

SUMMARY OF THE INVENTION

Therefore, an object of the present invention is to provide a display control device that controls a display with a relatively high response speed to display contents of a relatively low frame rate in order to minimize discontinuity and smoothen displayed image.

The present invention provides a display control device for controlling a display panel. The display control device includes a contents frame rate detector detecting a contents frame rate of an input image data and outputting a repetitive frame number dependent from a display frame rate of the display panel and the detected contents frame rate; a frame memory for storing a level data of a previous frame; and an emulated level generator in communication with the contents frame rate detector and the frame memory, generating an output level data to the display panel according to the repetitive frame number from the contents frame rate detector, the previous level data from the frame memory and an input level data of the input image data.

In an embodiment, the emulated level generator includes: a plurality of lookup tables corresponding to different repetitive frame numbers, respectively, in which correlating information among the previous level data, the input level data and the output level data are recorded; and a lookup table selector selects one of the lookup tables according to the repetitive frame number from the contents frame rate detector to be referred to so as to determine the output level data corresponding to the previous level data and the input level data.

In another embodiment, the emulated level generator is an emulated level operator which includes a counter cyclically counting from 1 to the repetitive frame number, and generates the output level data to the display panel according to the counted value from the counter, the previous level data from the frame memory and the input level data of the input image data.

The display control device according to the present invention allows the output level to change gently with time so as to minimize discontinuity and smoothen displayed image.

BRIEF DESCRIPTION OF THE DRAWINGS

The above contents of the present invention will become more readily apparent to those ordinarily skilled in the art after reviewing the following detailed description and accompanying drawings, in which:

FIG. 2 is a table summarizing input and output level changes during a series of frame time points in the embodiment of FIG. 1;

FIG. 5 is a table summarizing input and output level changes during a series of frame time points in the embodiment of FIG. 4.

DETAILED DESCRIPTION OF THE PREFERRED EMBODIMENT

Figure 1:
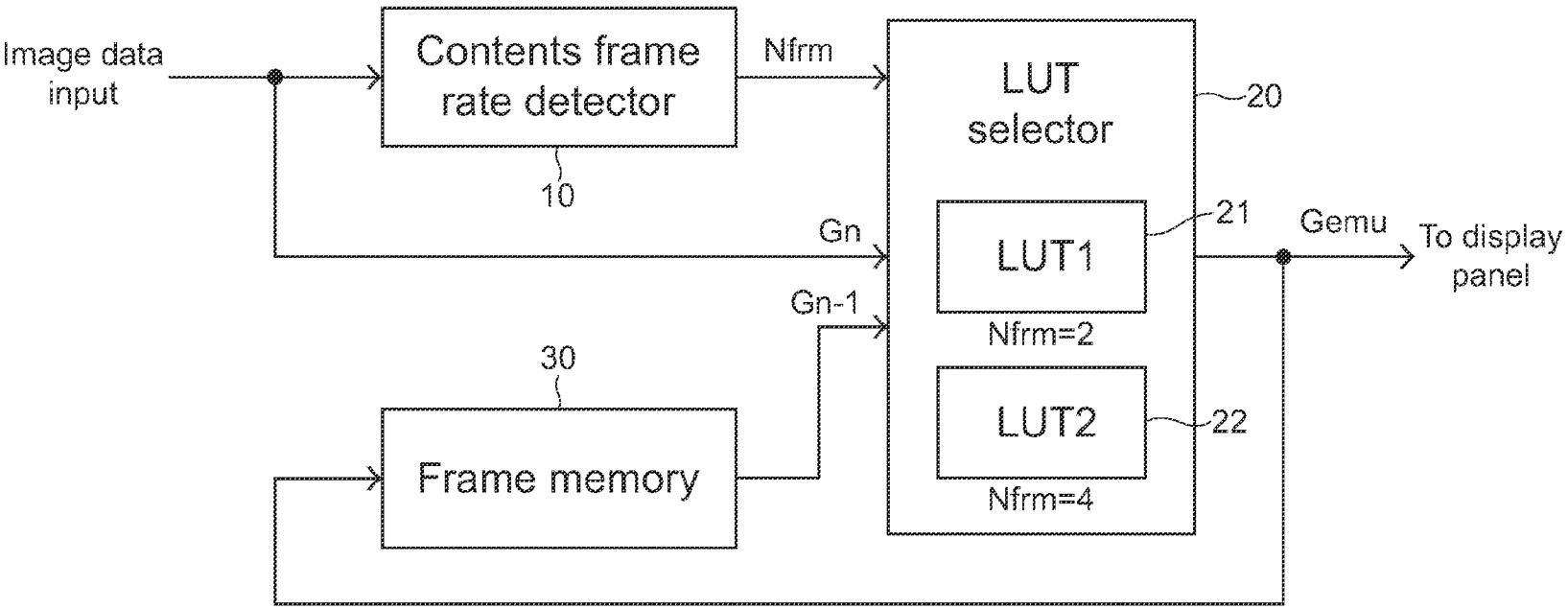
FIG. 1 is a functional diagram illustrating a display control device according to an embodiment of the present invention.

FIG. 1 illustrates a display control device according to an embodiment of the present invention. In this embodiment, a conventional LCD panel well known to those ordinary in the art is used with the present display control device and is thus not to be redundantly shown in the figure and described in detail.

Receiving an input image data, a contents frame rate detector 10 detects a frame rate of the input image data, e.g. 15 frames/sec for a one seg image or 24 frames/sec for a movie image, and outputs a repetitive frame number Nfrm relative to the 60 frames/sec standard display rate of the display device. Given that the contents frame rate is 30 frames/sec, Nfrm=2; and Given that the contents frame rate is 15 frames/sec, Nfrm=4.

The repetitive frame number Nfrm is then inputted into a lookup table (LUT) selector 20 to find a lookup table corresponding to the repetitive frame number Nfrm. For example, a lookup table LUT1 is selected for Nfrm=2; and another lookup table LUT2 is selected for Nfrm=4.

According to the selected lookup table, an emulated gray level Gemu corresponding to a gray level Gn of the input image and a previous gray level Gn-1 obtained from a frame memory 30 is realized and outputted to the display panel. Meanwhile, the value of the emulated gray level Gemu is stored into the frame memory 30 to replace the value of the previous gray level Gn-1.

FIG. 2 illustrates gray level changes with time in an example that the input image is a one seg image, wherein the repetitive frame number Nfrm is 4, and the corresponding lookup table is LUT2. Respective input and output gray levels of eleven frame time points 0~10 are illustrated.

Provided that the input level at the frame time point 0, i.e. indicative of black, the input level and output level for repetitive four frame time points 0~3 are all zero.

While entering the frame time point 4, the input level is changed to 63, i.e. white, and the emulated level value outputted from the lookup table LUT2 is 8. This level value 8 is stored into the frame memory 30 as a previous level Gn-1 and corresponds to an output level value 32 at the frame time point 5 according to the LUT2. Likewise, the output level value is 56 at the frame time point 6, and the output level value is 63 at the frame time point 7.

Figure 3:
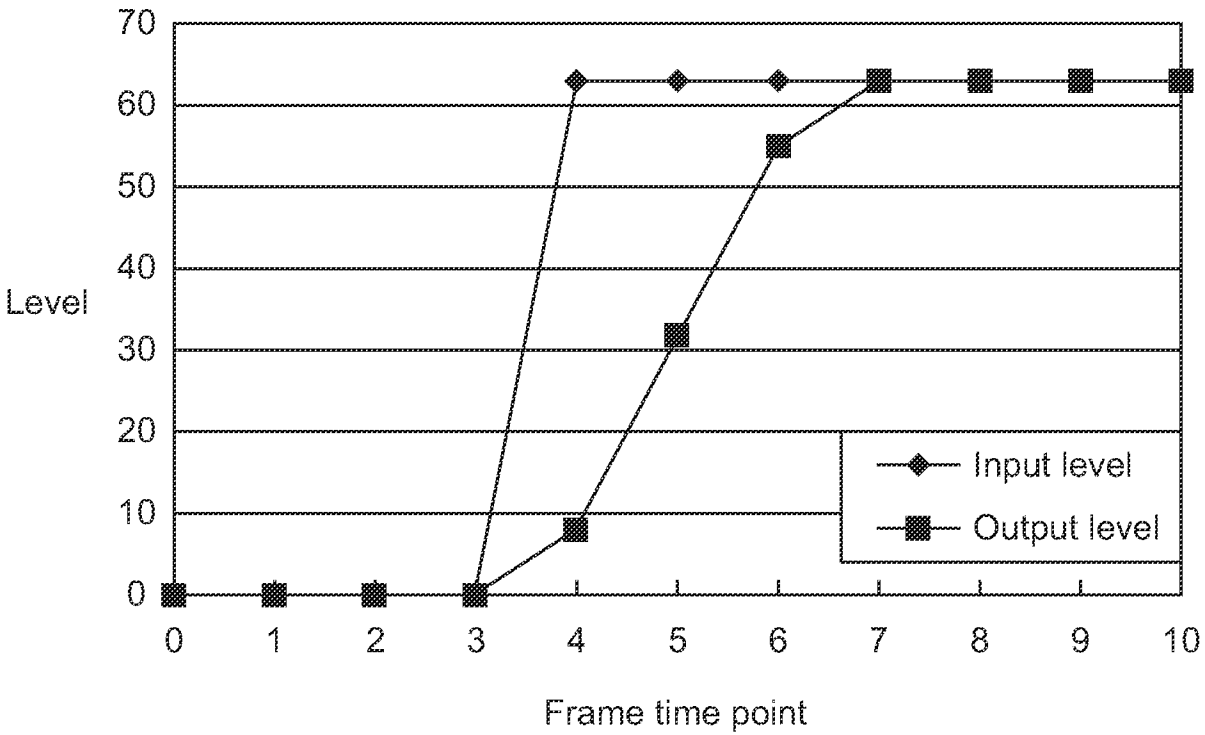
FIG. 3 is a plot showing level changes of FIG. 2 with curves.

In FIG. 3, input level changes and output level changes as shown in FIG. 2 are revealed as curves. As shown, the input level is dramatically changed from black to white gray level when time goes from the frame time point 3 to frame time point 4. In contrast, the output level gently changes from black to white gray level during the advancement of time from the frame time point 3 to frame time point 7. In this way, there would not be dramatic level change even if contents with a low frame rate are displayed by a display device with a high response speed. Accordingly, discontinuous action can be minimized and smooth image can be displayed.

In another example that the input image is of a film type having the frame rate of 24 frames per second, the repetitive frame number Nfrm is 60/24=2.5, either the lookup table corresponding to the repetitive frame number Nfrm=2 or the lookup table corresponding to the repetitive frame number Nfrm=3 can be used. Alternatively, the lookup table corresponding to Nfrm=2 and the lookup table corresponding to Nfrm=3 can be mixed or alternately used frame by frame so as to further improve display quality.

In brief, the above embodiment of the present invention smoothens the displayed image by setting lookup tables varying with repetitive frame numbers, detecting a repetitive frame number, and selecting a lookup table corresponding to the detected repetitive frame number.

Figure 4:
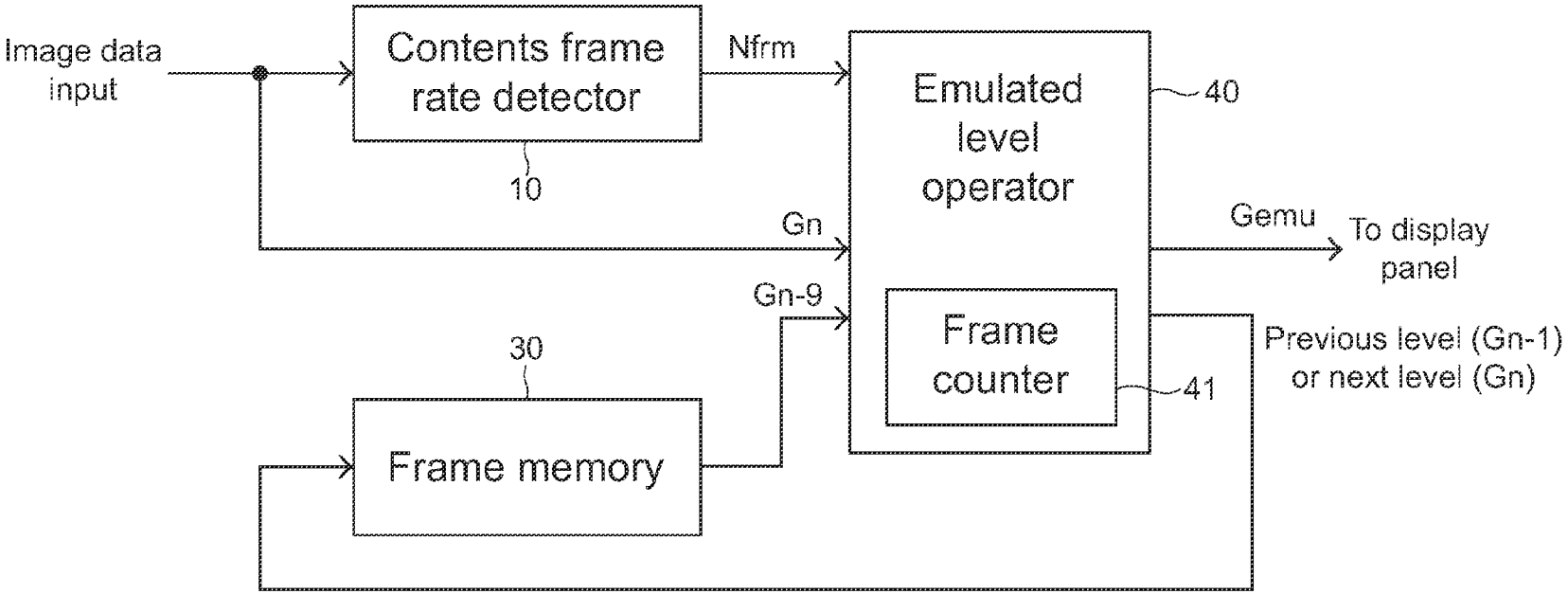
FIG. 4 is a functional diagram illustrating a display control device according to another embodiment of the present invention.

FIG. 4 illustrates a display control device according to another embodiment of the present invention. In this embodiment, the contents frame rate detector 10 and frame memories 30 similar to those used in the embodiment of FIG. 1 are used, and in addition, the display control device further includes an emulated level operator 40 in lieu of the LUT selector 20 of FIG. 1. In the emulated level operator 40, a frame counter 41 is disposed. The frame counter 41 accumulatively counts from 1 to the repetitive frame number Nfrm, and then repeats the counting from 1 to the repetitive frame number Nfrm.

For calculating level changes, it is set Gemu=Gn-1+(Gn−Gn-1)*k/Nfrm, where k is a counted value of the frame counter 41 and ranged from 1 to the repetitive frame number Nfrm.

FIG. 5 illustrates gray level changes with time in an example that the input image is a one seg image, wherein the repetitive frame number Nfrm is 4. Respective input and output gray levels of eleven frame time points 0~10 are illustrated. Similar to the embodiment shown in FIG. 2, the input level is 0 (black) during frame time points 0~3 and becomes 83 (white) at the frame time point 4.

Referring back to FIG. 4, the emulated level operator 40 calculates the output level value to the display panel based on the value Nfrm from the contents frame rate detector 10, the gray level Gn of the input image, and the value Gn-1 stored in the frame memories 30. In this embodiment, the input level value is stored into the frame memory 30 as the value Gn-1 whenever the frame counter 41 counts up to the value Nfrm. For example, in each of the frame time points 0~3, the initial value stored in the frame memory 30 is 0 and the gray level Gn of the input image is also 0, the output level value to the display panel is 0 accordingly (Gemu=0+(0−0)*k/4=0). Afterwards, at the frame time point 4, the input level value becomes 63, but the level values stored in the frame memory through the frame time point 6 are still 0 because the counted value has not reached the repetitive frame number 4. Once the counted value reaches 4 at the frame time point 7, the input level value 63 is stored into the frame memory.

The emulated level values at the frame time points 4~7 are then calculated based on the formula of Gemu=Gn-1+(Gn−Gn-1)*k/Nfrm, and realized as follows by way of round up or round down or truncation.

| | |
|---|---|
| 0+(63−0)×1÷4=16 | Frame time point 4 |
| 0+(63−0)×2÷4=32 | Frame time point 5 |
| 0+(63−0)×3÷4=47 | Frame time point 6 |
| 0+(63−0)×4÷4=63 | Frame time point 7 |

The emulated levels are outputted to the panel for display.

The level values stored in the frame memory at the frame time points 8 through 10 are all 63. Accordingly the emulated levels Gemu outputted to the panel are equal to 63+(63−63)*k/Nfrm=63.

Figure 6:
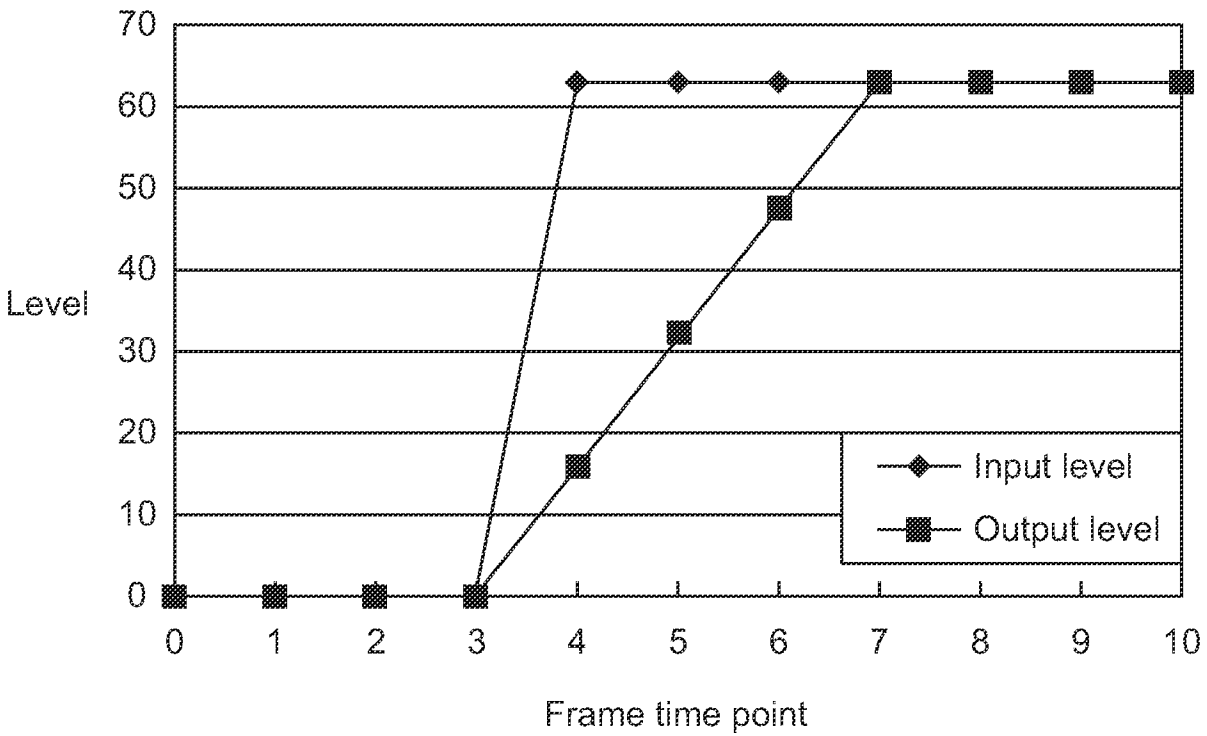
FIG. 6 is a plot showing level changes of FIG. 5 with curves.

FIG. 6 shows the gentle change of the output levels while the input levels dramatically changes from black to white gray level.

In this embodiment, no lookup table is required. Furthermore, it does not matter if the repetitive frame number is an integer or not.

It is understood that the output level may change following a reasonable curve such as a secondary curve, a parabolic curve, etc., even though it changes linearly in this embodiment.

To sum up, the display control device according to the present invention helps in displaying contents with a low frame rate smoothly in a display with a high response speed.

While the invention has been described in terms of what is presently considered to be the most practical and preferred embodiments, it is to be understood that the invention needs not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A display control device for controlling a display panel, comprising:

a contents frame rate detector detecting a contents frame rate of an input image data and outputting a repetitive frame number dependent from a display frame rate of the display panel and the detected contents frame rate;

a frame memory for storing a level data of a previous frame; and an emulated level generator in communication with the contents frame rate detector and the frame memory, generating an output level data to the display panel and the frame memory according to the repetitive frame number from the contents frame rate detector, the previous level data from the frame memory and an input level data of the input image data;

wherein the previous level data is obtained according to the output level data from the emulated level generator.

2. The display control device according to claim 1 wherein the emulated level generator comprises:

a plurality of lookup tables corresponding to different repetitive frame numbers, respectively, in which correlating information among the previous level data, the input level data and the output level data are recorded; and a lookup table selector selects one of the lookup tables according to the repetitive frame number from the contents frame rate detector to be referred to so as to determine the output level data corresponding to the previous level data and the input level data.

* * * * *